US006259425B1

(12) United States Patent
Shimizu

(10) Patent No.: US 6,259,425 B1
(45) Date of Patent: Jul. 10, 2001

(54) DISPLAY APPARATUS

(75) Inventor: Kan Shimizu, Urawa (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/063,384

(22) Filed: Apr. 21, 1998

(30) Foreign Application Priority Data

Apr. 21, 1997 (JP) ..... 9-103303

(51) Int. Cl.[7] ..... G09G 3/36
(52) U.S. Cl. ..... 345/94; 345/100; 345/58
(58) Field of Search ..... 345/55, 89, 58, 345/87, 94–100; 348/588, 678; 327/94

(56) References Cited

U.S. PATENT DOCUMENTS 4,804,924 * 2/1989 Chassaing et al. ..... 329/1
5,010,326 * 4/1991 Yamazaki et al. ..... 345/94
5,400,086 * 3/1995 Sano et al. ..... 348/678
5,434,453 * 7/1995 Yamamoto et al. ..... 257/777
5,442,406 * 8/1995 Altmanshofer et al. ..... 348/588
5,493,341 * 2/1996 Nam ..... 348/613
5,684,502 * 11/1997 Fukui et al. ..... 345/95
5,703,608 * 12/1997 Kuga ..... 345/99
5,940,057 * 8/1999 Lien et al. ..... 345/89

* cited by examiner

*Primary Examiner*—Steven Saras
*Assistant Examiner*—Tewolde Mengisteab
(74) *Attorney, Agent, or Firm*—Pillsbury Winthrop LLP

(57) ABSTRACT

A matrix type display apparatus includes a video signal voltage compensation circuit for suppressing distortion of a video signal produced on a video signal transmission bus mainly by the wiring resistance and a parasitic capacitance. The video signal voltage compensation circuit is connected to the input end of the video signal transmission bus to compensate waveform distortion of a video signal occurring on the video signal transmission bus while it is supplied to sample-hold circuits connected to the bus. The compensation circuit also includes a filter whose correction coefficient is varied in response to elapsed time from reception of a horizontal synchronizing signal.

9 Claims, 4 Drawing Sheets

DISPLAY APPARATUS

BACKGROUND OF THE INVENTION

1. Field of the Invention

This invention relates to a matrix type display apparatus, such as active matrix type liquid crystal display apparatus, especially one which includes a video signal voltage compensating circuit for reducing distortion of a video signal waveform which may occur on the bus for supplying a video signal to sample hold circuits in a relatively large-scale matrix type display apparatus.

2. Description of the Related Art

In conventional large-scale liquid crystal displays having a diagonal size of 30 cm or more and configured to drive signal lines of liquid crystal elements by sample-holding a video signal sequentially, because of insufficient operation speeds of conventional sample-hold circuits, an increased number of video signal transmission lines is used to transmit video signals in parallel and to limit video signal band widths narrower.

For example, it has been proposed to increase the number of video signal transmission lines to 24 lines, as many as eight times three lines used conventionally, to transmit video signals in parallel and to limit the video signal bandwidth to one eighth. This proposal certainly alleviates the need for operation speeds of sample-hold circuits and can decrease distortion so much as the required frequencies become lower.

However, this approach results in increasing the wiring area around the display portion due to an increased number of video signal transmission lines and in increasing the manufacturing cost because of the need for an increased number of circuits for outputting video signals.

Another problem with the use of an increased number of video signal transmission bus lies in distortion of video signals and interference between signals on the video signal transmission bus. The video signal transmission bus is disposed in parallel with one side of the display portion of a matrix-type display device. Therefore, the larger the diagonal size of the matrix-type display device, the longer the transmission bus. It results in increasing distortion of video signals and interference between different video signals that are transmitted in parallel.

Especially, in a active matrix TFT (Thin Film Transistor) liquid crystal display apparatus, or the like, in which liquid crystal display elements and thin-film transistors are formed integrally in an array on a glass substrate, since a thin-film electrode is used as the video signal transmission bus, which is made of aluminum or the like, the resistance value of the wiring is as large as approximately 1 kΩ, for example, and causes distortion of video signals beyond a negligible value.

FIG. 1 shows a construction of a conventional active matrix liquid crystal display device.

Connected to an input end of video signal transmission bus 53 are a gamma (γ) correction table circuit 10 for correction of output characteristics, connected to an input terminal IN supplied with video signals as display data, a digital-to-analog converter (DAC) 40 connected to the output of the gamma correction table circuit 10, and a video bus drive circuit 60 connected to the output of the digital-to-analog converter 40. Signal lines are connected (tapped) to the video signal transmission bus 53 via switches in periodical intervals. These switches are controlled by a sample-hold control circuit 51 made up of shift registers, for example, and form a sample hold circuit group 54 together with capacitors C1 associated with individual switches.

Scan lines controlled by a scan electrode drive circuit 52 extend across the signal lines. Provided at respective cross points are thin-film transistors, with gates connected to the scan lines, drains connected to signal lines and sources connected to liquid crystal pixels expressed in capacity, so that, when the thin-film transistors connected to the scan lines are driven by the scan electrode drive circuit 52, video signals are applied to pixel electrodes, and an image can be displayed.

The video signal transmission bus 53 has a relatively large resistance. Assuming that each signal line has a resistance rΩ and a floating (parasitic) capacitance CO as shown in FIG. 1, the resistance and the parasitic capacitance cause a distortion in wavelength of an input pulse signal. FIG. 1 shows waveforms X0, Y0 and Z0 at three nodes, namely, node X nearest to the input end, node Y in an intermediate position and node Z at the end, and shows that the distortion increases as nodes become remoter from the input end. In greater detail, the originally input pulse signal waveform appears at the node X0 nearest to the input end of the video signal transmission bus 53; however, a distortion caused by the resistance of the video signal transmission bus 53 and a parasitic capacitance appears in the signal waveform at the node Y0 positioned between the input end and the terminal end of the video signal transmission bus 53, and the distortion cumulatively increases as nodes approach the terminal end where, at the node Z0, the distortion of the signal waveform increases further. Causes of the distortion include the time constant of each pixel and influence from a preceding pixel, and influence of reflection especially from the wiring end cannot be disregarded.

SUMMARY OF THE INVENTION

It is therefore an object of the invention to provide a display apparatus capable of controlling distortion of video signal caused mainly by a wiring resistance and a parasitic capacitance on a video signal transmission bus.

According the first aspect of the present invention, there is provided a display apparatus comprising:

- a plurality of pixel capacitors in an matrix arrangement;
- a video signal transmission bus for transmitting a video signal;
- a plurality of sample-hold circuits connected to said video signal transmission bus to sample-hold said video signal in synchronism with a horizontal synchronizing signal;
- a plurality of signal lines for delivering sampled video signals from said sample-hold circuits to said pixel capacitors via switching elements; and
- a video signal voltage compensation circuit located at an input portion of said video signal transmission bus and provided with a filter for receiving said horizontal synchronizing signal and for varying frequency-amplitude characteristics of said video signal to be outputted to said video signal transmission bus in response to elapsed time from a reception of said horizontal synchronizing signal.

A display apparatus according to the invention uses a drive circuit having a sample-hold circuit block including a plurality of sample-hold circuits for sample-holding an entered video signal sequentially to sample the video signal sequentially and to drive signal lines of liquid crystal display devices, and connects a video signal voltage compensation circuit to the input end of a video signal transmission bus to which the sample-hold circuits are connected. The video signal voltage compensation circuit has a filter for compensating waveform distortion of the video signal which may occur on the video signal transmission bus while the video signal is supplied to the sample-hold circuits, and includes means for changing the coefficient for compensation by the filter depending upon the position on the video signal transmission bus where one of the sample-hold circuits currently under operation is connected.

Thus, the display apparatus can display high-quality and high-resolution images even in case of a large-scale liquid crystal display device, without increasing the number of video signal transmission bus lines at all, or so much, by changing the coefficient for signal compensation by the filter so as to minimize the distortion of the signal introduced into one of the sample-hold circuits under operation, depending upon the position of the sample-hold circuit on the video signal transmission bus and by alleviating waveform distortion of the video signal occurring on the video signal transmission bus of the matrix type display device and interference between three primary color video signals transmitted in parallel. Moreover, the invention can reduce the manufacturing cost and power consumption of the display apparatus because it uses a less number of analog video signal processing circuits which are expensive and consume a large power.

According to the second aspect of the present invention, there is provided a display apparatus comprising:

a plurality of pixel capacitors in a matrix arrangement individually for three primary colors;

first, second and third video signal transmission buses for transmitting three primary color video signals;

first to third sample-hold circuit blocks connected to said first to third video signal transmission buses to sample-hold said video signals in synchronism with horizontal synchronizing signals;

a plurality of signal lines for delivering sampled video signals from individual sample-hold circuits in said first to third sample-hold circuit blocks via switching elements; and first to third video signal voltage compensation circuits connected to input portions of said first to third video signal transmission buses and provided with a first to third filters for receiving said horizontal synchronizing signal and for respectively varying frequency-amplitude characteristics of said video signal to be outputted to said video signal transmission buses in response to elapsed time from reception of said horizontal synchronizing signal.

In this circuit, same compensation operations described above are respectively performed for three colors. Thus, the display apparatus can display high-quality and high-resolution images even in case of a large-scale liquid crystal display device, without increasing the number of video signal transmission bus lines at all, or so much, by changing the coefficient for signal compensation by the filters so as to minimize the distortion of the signals introduced into one of the sample-hold circuits under operation, depending upon the positions of the sample-hold circuits on each of video signal transmission buses and by alleviating waveform distortion of the three color video signals occurring on the video signal transmission buses of the matrix type display device and interference between three primary color video signals transmitted in parallel.

DESCRIPTION OF THE PREFERRED EMBODIMENTS

Figure 1:
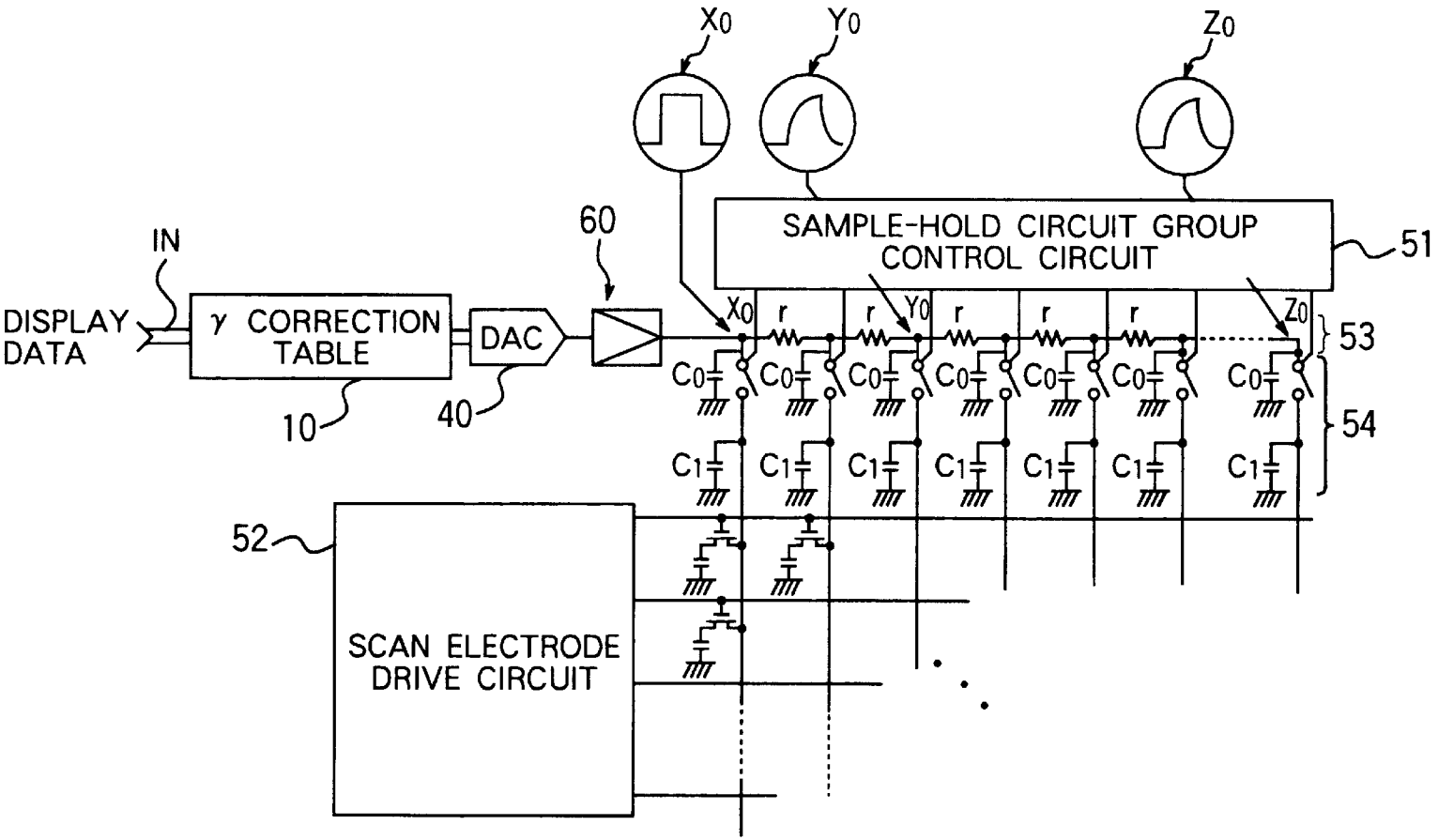
FIG. 1 PRIOR ART
FIG. 1 is a diagram showing a construction of a conventional active matrix type liquid crystal display device.

First explained is the fundamental principle of the present invention.

Distortion of video signals on a video signal transmission bus and interference between video signals on different buses, in general, can be estimated by calculation or experiments. However, distortion of signals on a video signal transmission bus varies with positions of switches on the bus as referred to above, and it is impossible to compensate the distortion of signals to remove it simultaneously at all positions where sample-hold circuits are connected.

Sample-hold circuits, however, are not operated simultaneously, but are sequentially activated for sampling operation, from one to another corresponding to display positions.

Taking it into account, the display apparatus according to the invention includes a video signal voltage compensation circuit connected to an input side of the video bus and having a filter which is responsive to horizontal synchronizing signals to generate different coefficients for compensating different values of distortion in the video signal waveforms appearing on the video bus, depending on positions on the video bus.

More specifically, by counting horizontal synchronizing signals, it is decided whichever one of sampling elements connected to the video bus should sample the input video signal. Then, the filter compensates the video signal, using a specific distortion compensation coefficient, depending on a specific position on the video bus. It is the feature of the invention to compensate distortion of the signal and to reduce interference between signals substantially throughout the entire length of the bus by using the fact that, at a specific moment, only a signal applied to a particular position of the bus is used, although it is impossible to compensate the distortion of the video signal on the video signal transmission bus over the entire length of the bus. That is, in order to compensate the distortion of the signal generated on the bus and to alleviate interference between signals over the entire length of the video signal transmission bus, the coefficient of the filter for compensating distortion of signals and for alleviating interference is changed, depending upon the position of the video signal transmission bus where the currently activated sample-hold circuit is connected. The filter used in the invention may be a transversal filter, for example.

Additionally, in order to compensate distortion caused by reflection of signals at the terminal end of the video signal transmission bus, the coefficient of the transversal filter may be optimized, or its function may be limited.

That is, in case that the video signal transmission bus has a small resistance and is opened at the terminal end, part of video signals reflected back at the open end mixes with the signal propagating on the bus and distorts the video signal waveform on the bus. Therefore, in order to prevent multi reflection, the bus drive circuit is preferably designed to match with the bus in characteristic impedance as far as possible.

For the purpose of compensating distortion of signals caused by the resistance and the capacitance of the video signal transmission bus, the coefficient of the transversal filter is optimized, or its function is limited. Alternatively, both may be done in combination.

In case that each sample-hold circuit is made up of a simple switch and a hold capacitor, and no interference amplifier is inserted between the video signal transmission bus and each sample-hold circuit, it is preferable for all sample-hold circuits to sample-hold a common voltage before sampling of the video signal by the mass of the sample-hold circuits. In this circuit arrangement, however, if a prior sample-held voltage remains, the capacitance of the bus may appear changed, and compensation of the signal distortion may fail.

Additionally, in case that video signal transmission buses corresponding to three primary colors are provided in parallel for color display, for example, a circuit is provided to alleviate interference between signals transmitted through respective buses. Since interference between video signals increases as they go remoter from the input ends of the video signal buses, the coefficient of the interference alleviating circuit is changed, depending upon the position of the currently activated sample-hold circuit on the bus.

The coefficient for switches of the transversal filter need not be changed every switch position where each sample-hold circuit is connected, but may be changed for some blocks made by dividing the entire length of the video bus and each containing some switch positions. The video bus may be divided so that blocks are longer as they become remoter from the input end of the video bus.

Explained below are display apparatus embodying the invention with reference to the drawings.

Figure 2:
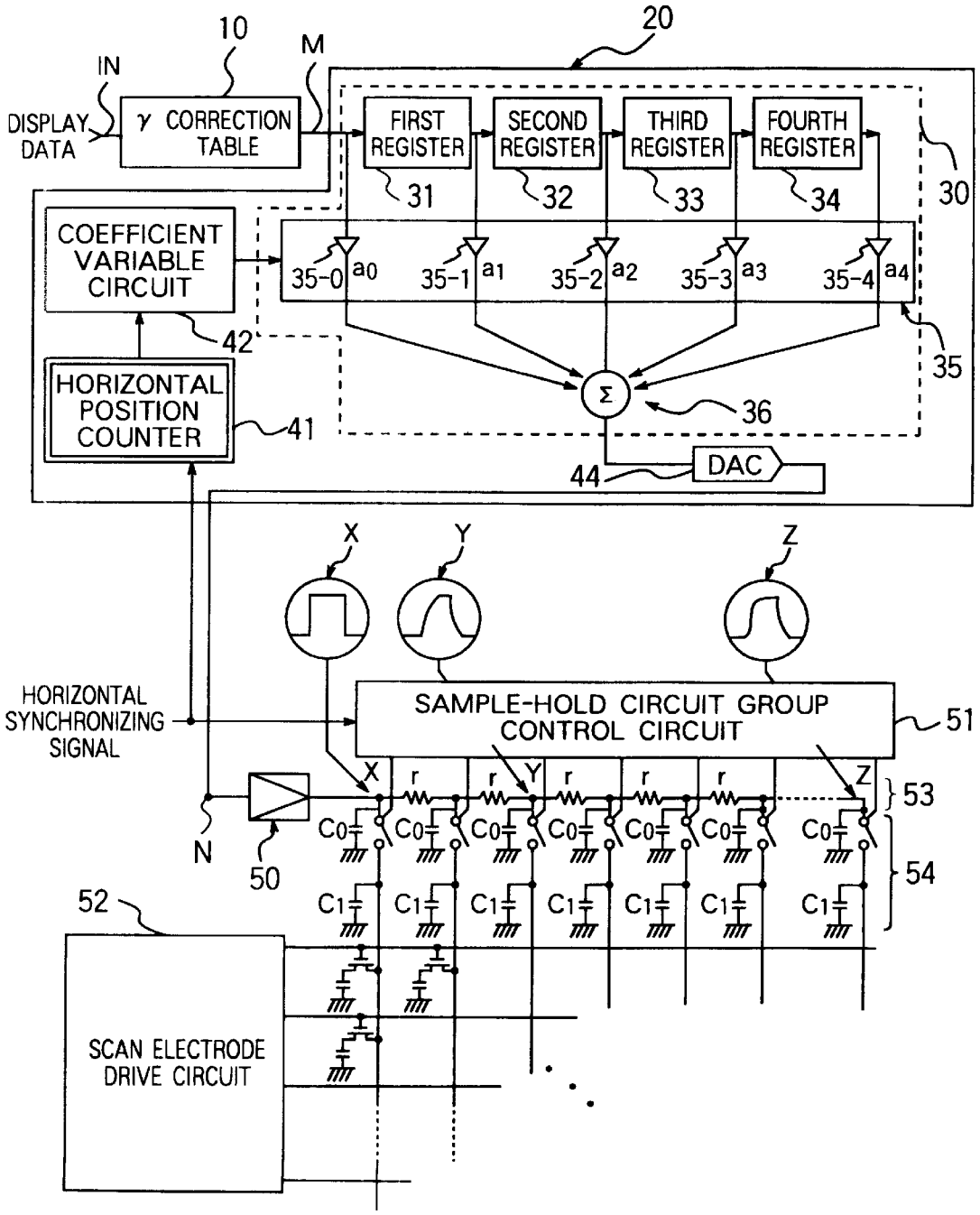
FIG. 2 is a circuit diagram of a video signal voltage compensation circuit in a matrix type display device, taken as a first embodiment of the invention.

FIG. 2 shows a circuit arrangement of a display apparatus taken as the first embodiment of the invention, as applied to an active matrix type liquid crystal display device.

Gamma correction table circuit 10 for correction output characteristics is connected to an input terminal IN where video signals as display data are input. Connected to the output of the gamma correction table circuit 10 is a video signal voltage compensation circuit 20 which is one of unique features of the invention. An amplifier 50 connected to the output of the video signal voltage compensation circuit 20 is connected to the input end of a video signal transmission bus 53.

Similarly to the conventional example, signal lines are connected to the video signal transmission bus 53 at switch positions in constant intervals via sample-hold circuits 54 controlled by a sample-hold control circuit 51 made up of shift registers. Scan lines having scan electrodes controlled by a scan electrode drive circuit 52 extend across the signal lines so that, when the scan electrodes of respective scan lines are driven sequentially by the scan electrode drive circuit 52, video signals be applied to pixel electrodes and an image be displayed.

Next explained in detail is the construction of the video signal voltage compensation circuit 20. The circuit includes a horizontal position counter 41 for counting horizontal synchronizing signals to identify one of sample-hold circuits 54 currently under operation, and a coefficient variable circuit 42 responsive to the count value of the horizontal position counter 41 to change the coefficient to be used for compensation by the signal voltage compensation filter, which is a coefficient having a 10-bit length by multiplication of multipliers forming the filter. The video signal voltage compensation circuit 20 further includes a filter 30 responsive to an output of the coefficient variable circuit 42 to compensate the video signal voltage in data which is input to the input terminal IN, then corrected by the gamma correction table circuit 10*a* and introduced into the filter 30 as liquid crystal voltage data through a node M, and a DA converter 44 of eight bits connected to the output of the filter 30. Output of the DA converter 44 is the output of the video signal voltage compensation circuit 20, namely, the compensated video signal, and it is applied to an amplifier 50 from a node N.

The coefficient variable circuit 42 is a kind of memory tables. Different coefficients are previously determined through experiments or simulation, explained later, accounting the type of the liquid crystal display device, panel size, wiring length, number of dots, width of the path, and so forth, and the coefficient variable circuit 42 stores these coefficients in addresses determined by count values of the horizontal position counter.

The filter 30 is a transversal filter which includes first to fourth eight-bit registers 31 through 34 connected in series to the output of the gamma correction table circuit 10, a block of multipliers 35 including No. 0 to fourth multipliers 35-0 thorough 35-4 which are supplied with input of the first register 31 and outputs of the first to fourth registers 31 through 34, and an adder 36 for adding output of the multipliers 35.

The compensated video signal passing thorough the node N is amplified by the amplifier 50, and then sent onto the video signal transmission bus 53 of the TFT liquid crystal device having sample-hold circuits 54 for sample-holding the video signal input successively.

The video signal voltage compensation circuit 20 compensates the video signal voltage so as to diminish the distortion of the video signal at a switch position on the video signal transmission bus 53 a, where one of sample-hold circuits 54 under operation is connected, and to thereby prevent distortion on the video signal transmission bus. Since the sample-hold circuits are configured to hold a video signal voltage immediately before the switches are opened, it is sufficient to compensate the video signal voltage at the switch position of the outstanding sample-hold circuit at the timing immediately before the switch of the sample-hold circuit opens. The compensation is accomplished by changing, from time to time, the frequency-amplitude characteristics of the filter disposed at the input of the video bus, as will be explained later.

Next explained are behaviors of the video signal voltage compensation circuit 20 used in the display apparatus according to the invention. The first to fourth registers 31 through 34 are shift registers whose outputs, namely the display data, are periodically renewed every time the display data is input. No. 0 to fourth multipliers 35-0 through 35-4 multiply the input of the first register 31 by coefficient a, and outputs of the first to fourth registers 31 through 34 by coefficients A1 through a, and their sum is made by the adder 36. As a result, distortion of the signal on the video signal transmission bus 53 is compensated by the transversal filter 30. The compensated data is DA-converted into a compensated video signal by the DA converter 44, then amplified by the amplifier 50, and input to the input terminal X of the video signal transmission bus 53 the transversal filter 30 to drive the video signal transmission bus 53.

The amount of distortion of the video signal varies with switch position on the video signal transmission bus 53.

Therefore, depending upon the switch position of the sample hold circuit currently under operation, coefficients a through a of No. 0 to fourth multipliers 35-0 through 35-4 are changed. Changes of coefficients are controlled by the horizontal position counter 41 and the coefficient variable circuit 42.

Since the sample hold circuits 54 are activated sequentially from the left-end circuit in FIG. 2, the horizontal position counter 41 counts to identify the order of the input pixel, namely, the position of the sample-hold circuit supplied with display data. That is, the horizontal counter 41 is supplied with horizontal synchronizing signals for driving shift registers of the sample-hold control circuit 51, and counts signals made by multiplying the horizontal synchronizing signals. Since the sample hold circuits are sequentially activated for sampling operation in synchronism with the multiplied signals, the coefficient variable circuit 42 for compensating the display signal at the sampling position changes the coefficients a to a of the No. 0 to fourth multipliers 35-0 through 35-4 at the moment when left-end one eighth of the sample-hold circuits 54 completes sample-hold operation or at the moment when left-side one half completes sample-hold operation.

Coefficients a through a of No. 0 to fourth multipliers 35-0 through 35-4 are determined as follows.

For each of the switch positions on the video signal transmission bus 53 where the sample-hold circuits are connected, a response corresponding to an impulse response is obtained. That is, a transient response to the video signal in form of a rectangular pulse with a width equal to the sampling cycle is obtained for each sampling cycle. Note here that transient responses of DA converter 44 and the amplifier connected to the output node N of the DA converter 44 and the transient response of the video signal transmission bus 53 should be taken into account. Since the DA converter 44 and the sample-hold circuits have delays for their operations, their operation phases are changed and settled within a predetermined range to maximize the average output of the sample-hold circuits 54. The response corresponding to the impulse response can be obtained either by simulation or by experiments. Since the sample-hold circuit generates an offset voltage due to a punch-through of the pulse signal which controls its switch, it is important to use an average value of responses to two kinds of signals inverted in polarity.

After that, the switches are divided into some blocks of adjacent switches having transient responses close to each other, and an average of transient responses of adjacent switches is obtained for each block. Then, the coefficient of the transversal filter 30 for compensating the transient response is calculated, and the voltage held in each sample-hold circuit when compensated by the transversal filter 30 is calculated. If the result of the compensation exhibits a difference larger than one step of 256 grades, for example, the switches are re-divided into smaller blocks, and the coefficient of the transversal filter is re-calculated to ensure sufficient compensation of distortion of the video signals.

For calculation of the coefficient of the transversal filter 30 from the response corresponding to the impulse response for each blocks of adjacent switches, a known method shown below can be used.

Assume here that the response corresponding to the impulse response is (0.01, 0.792, 0.165, 0.034), which is a response when the sampling frequency is approximately four times the band width of 3 dB. The first term, 0.01, is the response generated by a delay of the holding operation of a sample-hold circuit, which is the response to a signal subsequent to a target signal.

Letting the original signal be fn and the transient response be hn−1=0.01, hn=0.792, hn+1=0.165 and hn+2=0.034 (where suffixes of f and h indicate times), it can be expressed as $$hn=0.792fn+0.165fn-1+0.034fn-2$$

$$hn-1=0.01fn+0.792fn-1+0.165fn-2+0.034fn-3$$

$$hn-2=0.01fn-1+0.792fn-2+0.165fn-3+0.034fn-4$$

$$hn-3=0.01fn-2+0.792fn-3+0.165fn-4+0.034fn-5$$

$$hn-4=0.01fn-3+0.792fn-4+0.165fn-5+0.034fn-6$$

$$hn-5=0.01fn-4+0.792fn-5+0.165fn-6+0.034fn-7$$

$$hn-6=0.01fn-5+0.792fn-6+0.165fn-7+0.034fn-8$$

$$hn-7=0.01fn-6+0.792fn-7+0.165fn-8+0.034fn-9$$

It is solved as $$fn-3=-0.016hn-2+1.269hn-3-0.263hn-4+0.011hn-6$$

$$fn-4=-0.016hn-3+1.269hn-4-0.263hn-5+0.011hn-7$$

Therefore, the original signal fn can be approximated by the transient response hn as $$fn=-0.016hn+1.269hn-1+0.011hn-3$$

Thus, coefficients of a0 to a4 of No. 0 to fourth multipliers 35-0 through 35-4 results in $$a0=-0.016, a1=1.269, a2=-0.263,\ a3=0, a4=0.011$$

In the above simultaneous equations, since responses hn+1 and hn+2 to fn are regarded 0, and responses hn−10, hn−9 and hn−8 to fn−9 are regarded 0, solutions of fn, fn−1, fn−9, fn−8, etc. nearer to opposite ends have large differences. Therefore, solutions of fn−3, fn−4, etc. in central positions are used, confirming that these solutions have small differences.

At the input end of the video transmission bus 53, namely at the node X, the signal waveform has substantially no distortion. Distortion of the signal waveform increases as the nodes become closer to the terminal end node Z. For example, responses corresponding to impulse responses to fn at switches in the left-end one eighth region in FIG. 2, for example, can be approximated as hn+1=hn=1, hn−1=0 and hn−2=0, and responses corresponding to impulse responses to fn at switches in the right half region can be approximated as hn+1=0.01, hn=0.792, hn−1=0.165 and hn−2=0.034. Since the amount of distortion of the signal waveform varies with switch position, it is impossible to compensate the distortion of the waveform at all switch position simultaneously.

As a result of calculation of coefficients a to a of No. 0 to fourth multipliers 35-0 through 35-4 by the above computing method, coefficients of multipliers at switches from the left end to the one-eighth length are $$a=0,\ A1=1,\ a2=0,\ ad=0 \text{and} a=0$$

Coefficients of multipliers at next switches to the left one half length are $$a=0,\ A1=1.045,\ a2=-0.045,\ a3=-0.002 \text{ and } a=0$$

Coefficients of multipliers at switches in the right one half length are $$a=-0.016,\ A1=1.269,\ a2=-0.263,\ a3=0 \text{ and } a=0.011$$

In the case of multipliers at next switches to the left circuits at respective switches are $$0V,\ 0V,\ 0V,\ 0V, 0V,\ 1V,\ 0V,\ 0V,\ 0V,\ 0V \text{ and } 0V$$

sequential calculation of correction outputs for left-end one-eighth switches results in values as shown in Table 1.

TABLE 1

| Input Coef. = 0 | Register 1 Coef. = 1 | Register 2 Coef. = 0 | Register 3 Coef. = 0 | Register 4 Coef. = 0 | Correction output |
|---|---|---|---|---|---|
| 0 V | — | — | — | — | — |
| 0 V | 0 V | — | — | — | — |
| 0 V | 0 V | 0 V | — | — | — |
| 0 V | 0 V | 0 V | 0 V | — | — |
| 0 V | 0 V | 0 V | 0 V | 0 V | 0 V |
| 0 V | 0 V | 0 V | 0 V | 0 V | 0 V |
| 1 V | 0 V | 0 V | 0 V | 0 V | 0 V |
| 0 V | 1 V | 0 V | 0 V | 0 V | 1 V |
| 0 V | 0 V | 1 V | 0 V | 0 V | 0 V |
| 0 V | 0 V | 0 V | 1 V | 0 V | 0 V |
| 0 V | 0 V | 0 V | 0 V | 1 V | 0 V |

Since the corrected video voltage, with no distortion, is delivered to switches in the left-end one-eighth switch positions, {0V, 0V, 0V, 1V, 0V, 0V, 0V} are sampled sequentially in adjacent sample-hold circuits. It results in sampling the target voltage, namely, the voltage equal to the input.

Similar sequential calculation of correction outputs for switches in the block from the left one-eighth position to the left one-half position results in values as shown in Table 2.

TABLE 2

| Input Coef. = 0 | Register 1 Coef. = 1.045 | Register 2 Coef. = −0.045 | Register 3 Coef. = −0.002 | Register 4 Coef. = −0.002 | Correction output = 0 |
|---|---|---|---|---|---|
| 0 V | — | — | — | — | — |
| 0 V | 0 V | — | — | — | — |
| 0 V | 0 V | 0 V | — | — | — |
| 0 V | 0 V | 0 V | 0 V | — | — |
| 0 V | 0 V | 0 V | 0 V | 0 V | 0 V |
| 0 V | 0 V | 0 V | 0 V | 0 V | 0 V |
| 1 V | 0 V | 0 V | 0 V | 0 V | 0 V |
| 0 V | 1 V | 0 V | 0 V | 0 V | 1.045 V |
| 0 V | 0 V | 1 V | 0 V | 0 V | −0.045 V |
| 0 V | 0 V | 0 V | 1 V | 0 V | −0.002 V |
| 0 V | 0 V | 0 V | 0 V | 1 V | 0 V |

Next computed are voltages sampled in sample-hold circuits connected to the switches. Since the responses to the corrected video voltage fn at switches in the left one half length could be approximated as hn+1=0, hn=0.957, hn−1=0.0413 and hn−2=0.0002, values in Table 3 are obtained by using the following equation $$hn=9\times fn+1+0.957fn+0.0413fn-1+0.0002fn-2$$

TABLE 3

| fn + 1 | fn | fn − 1 | fn − 2 | hn |
|---|---|---|---|---|
| 0 V | 0 V | 0 V | 0 V | 0 V |
| 0 V | 0 V | 0 V | 0 V | 0 V |

TABLE 3-continued

| fn + 1 | fn | fn − 1 | fn − 2 | hn |
|---|---|---|---|---|
| 1.045 V | 0 V | 0 V | 0 V | 0.00 V |
| −0.045 V | 1.045 V | 0 V | 0 V | 1.00 V |
| −0.002 V | −0.045 V | 1.045 V | 0 V | 0.00 V |
| 0 V | −0.002 V | −0.045 V | 1.045 V | 0.00 V |
| 0 V | 0 V | −0.002 V | −0.045 V | 0.00 V |
| 0 V | 0 V | 0 V | −0.002 V | 0.00 V |

In the left one half length, the corrected video voltage is delivered to switches as being distorted on the video transmission bus 53, and {0V, 0V, 0V, 1V, 0V, 0V, 0V} are sampled in adjacent sample-hold circuits as shown in Table 3. It results in sampling the target voltage, namely the voltage equal to the input.

Similarly, calculation of correction video voltages to switches in the left one half length results in {0V, 0.016V 1.269V, −0.263V, 0V, −0.011V, 0V}. By similarly computing voltages sampled in respective adjacent sample-hold circuits, values in Table 4 are obtained from the following equation.

$$hn=0.01\times fn+1+0.792fn+0.165fn-1+0.034fn-2$$

TABLE 4

| fn + 1 | fn | fn − 1 | fn − 2 | hn |
|---|---|---|---|---|
| 0 V | 0 V | 0 V | 0 V | 0 V |
| −0.016 V | 0 V | 0 V | 0 V | 0.00 V |
| 1.269 V | −0.016 V | 0 V | 0 V | 0.00 V |
| −0.263 V | 1.269 V | −0.016 V | 0 V | 0.999 V |
| 0 V | −0.263 | 1.269 V | −0.016 V | 0.00 V |
| −0.011 V | 0 V | −0.263 V | 1.269 V | 0.00 V |
| 0 V | −0.011 V | 0 V | −0.263 V | 0.00 V |
| 0 V | 0 V | −0.011 V | 0 V | 0.008 V |

Thus, the error of 200 mV is reduced to 8 mV.

As explained above, even when the video signal is distorted on the video transmission bus 53, the frequency-amplitude characteristic of the filter is changed and set appropriately from time to time by changing the coefficient of the transversal filter 30 depending upon the position where the sample-hold circuit under operation is connected, such that any of the sample-hold circuits can sample a predetermined voltage. That is, signal waveforms appearing at nodes X, Y and Z in FIG. 2 exhibit voltages of predetermined values with less distortion as compared with signal waveforms at nodes X0, Y0 and Z0 in FIG. 1.

In the present embodiment, switches and hold-capacitors of sample-hold circuits are directly connected to the video transmission bus 53. In this case, since the degree of distortion is changed by voltages previously held in sample-hold circuits, the hold-capacitors are preferably reset during horizontal blanking periods of the display. That is, it is recommended for all sample-hold circuits in the sample-hold circuits block 54 to sample a common voltage before individual sample-hold circuits sample-hold the video signal sequentially.

Furthermore, the present embodiment uses 10-bit multipliers as all of the multipliers forming the transversal filter; however, multipliers with a less number of bits can be used as No. 0, second, third and fourth multipliers 35-0, 35-2, 35-3 and 35-4 because absolute values of their coefficients a, a2, a3 and a are small than 1 whereas the coefficient Al of the first multiplier 35-1 is slightly larger than 1. Although the transversal filter 30 used here has five steps, any appropriate number of steps may be determined, taking the required accuracy, degree of distortion, manufacturing cost, power consumption, and so forth, into account.

The transversal filter used in the present invention is one of those widely used in the field of communication technologies. Designing them to be variable in coefficient is also one of conventional technologies. Transversal filters are configured to be variable and adjusted in coefficient to compensate the affinity of the transmitter and the receiver, characteristics of the selected transmission line, drift of the characteristics of the transmission line, and so forth.

However, although transversal filters conventionally used in the field of communication technologies are adjusted in coefficient to optimize compensation of various factors, once they are installed transmission lines, these adjusted values of coefficients remain unchanged. That is, these coefficients are never changed from time to time, depending upon various conditions, such as voltage value of the signal traveling through the transmission line, operations of the transmitter and the receiver.

In contrast, the display apparatus according to the invention is characterized in that, when a transversal filter is used in the compensation circuit for compensating distortion of the signal and for alleviating interference between signals, its frequency-amplitude characteristics are changed appropriately from time to time depending upon the position on the video signal transmission bus where a sample-hold circuit currently under operation is connected. Therefore, it is different from conventional adjustment of coefficients of transversal filters which is done as initial setting before installation into transmission lines.

Moreover, the video signal voltage compensation circuit of the display apparatus according to the invention is different in that it compensates signal voltages sequentially sampled in a number of sample-hold circuits, and not in a single receiver circuit. Another difference of the video signal voltage compensation circuit of the display apparatus according to the invention lies in that, in a liquid crystal display device using such circuit, it is difficult to detect outputs of sample-hold circuits during operation, and coefficients must be determined previously.

Although it is impossible to compensate distortion of waveforms simultaneously over the entire length of the video signal transmission bus, it is the essential feature of the present invention that it results in compensating distortion substantially over the entire length of the bus, by utilizing the fact that the position of sample-holding operation moves sequentially from one sample-hold circuit to another which are connected at different positions of the bus and that it is sufficient to compensate the target voltage only at one point of the bus at a moment.

Figure 3:
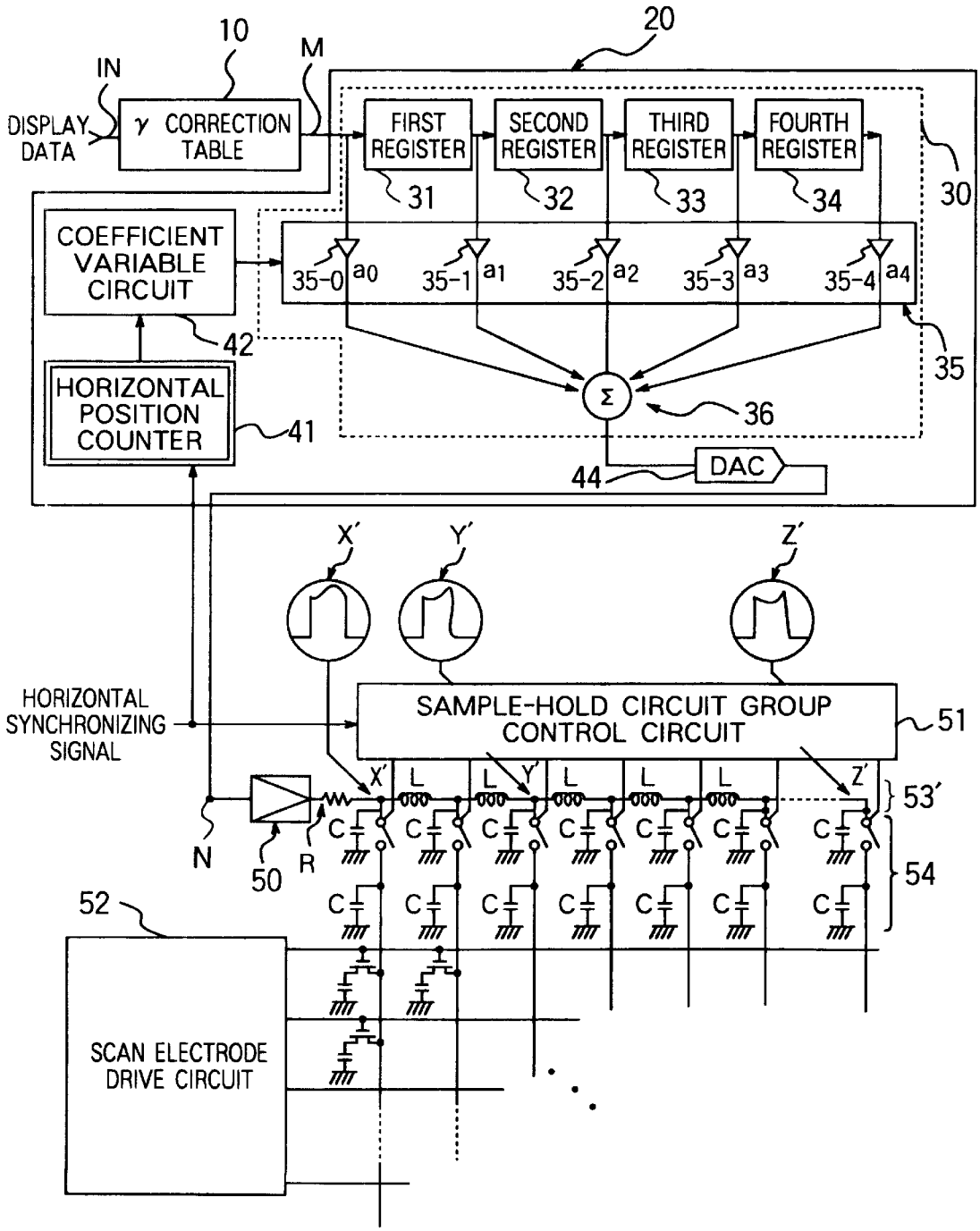
FIG. 3 is a circuit diagram of a video signal voltage compensation circuit in a matrix type display device, taken as a second embodiment of the invention.

FIG. 3 is a circuit diagram of a display apparatus taken as the second embodiment of the invention.

The first embodiment has been directed to compensation of signal distortion caused by a high resistance of the video signal transmission bus. The second embodiment, however, is to compensate distortion of video signals in the case where the video signal transmission bus is long and has a relatively small resistance, which causes return signals reflected back from the terminal end of the bus mix with the signal traveling from the input end to the terminal end of the bus and causes such distortion. Therefore, FIG. 3, illustrating the second embodiment, shows inductance L on the video signal transmission bus 53' in lieu of resistance r shown on the video signal transmission bus 53 in FIG. 2. Another difference of the second embodiment from the first embodiment lies in that a final-end resistor R is inserted and connected between the amplifier 50 and node X' so that the video signal transmission bus 53' be sending-end-terminated by the characteristic impedance for reasons explained below.

Construction of the video signal voltage compensation circuit 20, itself, and the way of setting coefficients of the transversal filter are the same as those of the first embodiment. That is, the circuit reviews a response corresponding to the impulse response at each switch connecting each sample-hold circuit to the video signal transmission bus 53', and subsequently calculates a coefficient of the transversal filter 30 to compensate distortion of the signal at each switch and to restore the original waveform.

As shown in FIG. 3, portions around the video signal transmission bus 53' are preferably configured to sending-end-terminate the video signal transmission bus 53' with its characteristic impedance. If the terminal end of the video signal transmission bus 53' is matching-terminated, no reflective wave is produced, and signals are not distorted. However, this mode of termination is not desirable because the terminating resistor R consumes power also when the video signal voltage does not change. Sending-end termination by the terminating resistor R having an appropriate resistance value can reduce the average consumption power because the terminating resistor R does not consume power when the video signal voltage does not vary.

Figure 4:
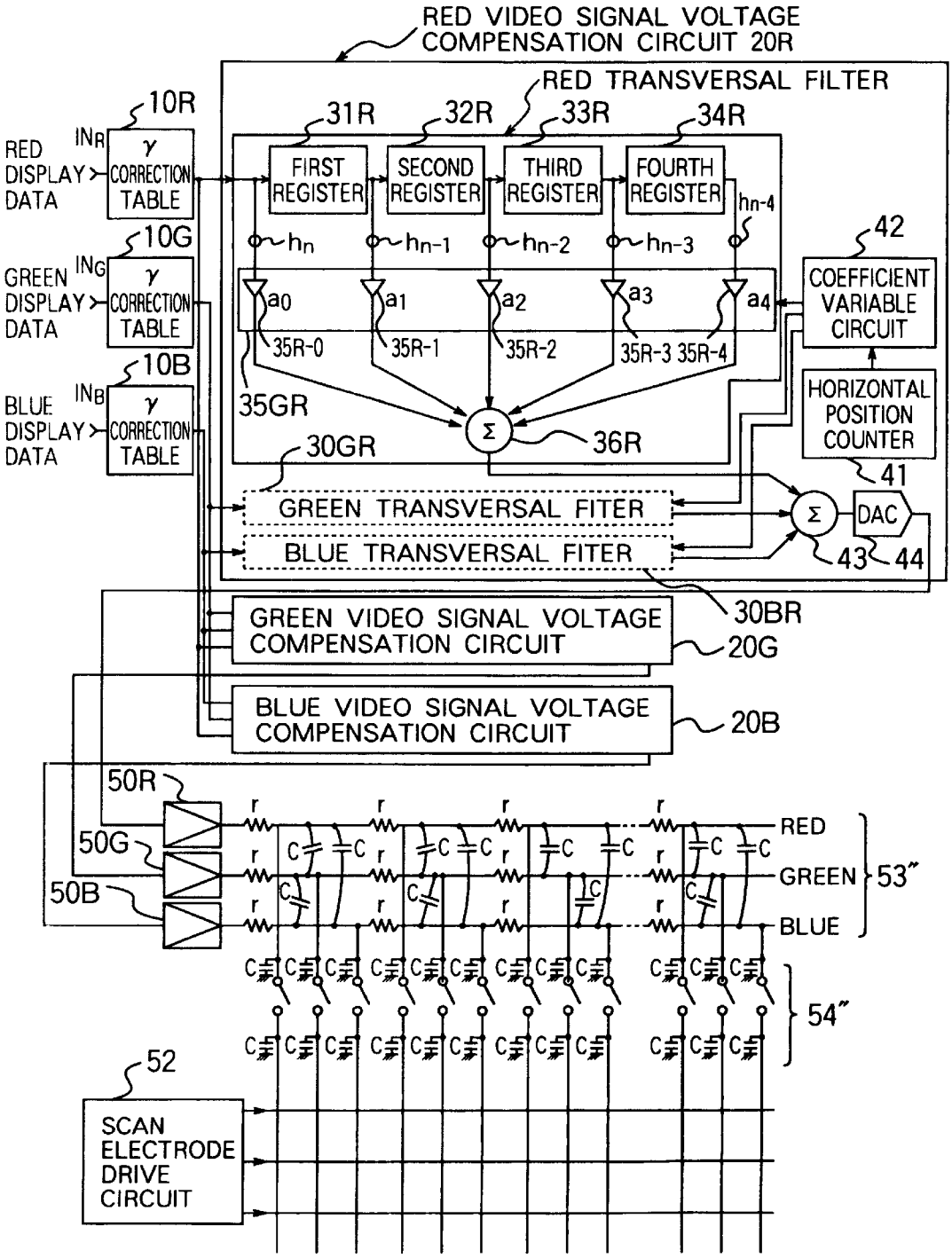
FIG. 4 is a circuit diagram of a video signal voltage compensation circuit in a matrix type display device, taken as a third embodiment of the invention.

FIG. 4 is a circuit diagram of a display apparatus taken as the third embodiment of the invention.

The third embodiment is an arrangement applied to a color display apparatus. In color display apparatuses, in general, video signal transmission lines are used for respective primary color signals, like those shown at 53" in FIG. 4, in order to prevent interference among different color signals. Although the construction explained with the first or second embodiment can alleviate interference of different signals by commonly using a single line for three primary color signals, different video signal transmission bus lines are preferably used for different primary color signals because primary color signals for images have a small correlation.

However, also when different video signal transmission lines are used for individual primary color signals, since they are provided to extend in parallel, there still remains an interference between primary color signals caused by a capacitance generated between these lines, and it is especially serious in large-scale liquid crystal displays.

Taking it into account, the above-explained video signal voltage compensation circuit is used to add a compensation signal for alleviating the interference to the drive signal for driving the video signal transmission bus line 53". The interference alleviating compensation voltage is changed in value for different video signal transmission bus lines for different colors, because, at each switch position on the bus where a sample-hold circuit is connected, there is a difference in degree of interference and in effect by the compensation signal among different colors.

In order to compensate distortion of three primary color signals on video signal transmission lines and to alleviate their interference, the video signal voltage compensation circuit according to the third embodiment is arranged as explained below.

This embodiment uses three sets of video signal voltage compensation circuits for red, green and blue. Since these circuits are identical in construction, only one of them, namely, the red video signal voltage compensation circuit 20R, is explained and illustrated in FIG. 4 in detail, and the others are explained and illustrate roughly.

The red video signal voltage compensation circuit 20R includes a red transversal filter 30RR, green transversal filter 30GR, and blue transversal filter 30BR. Coefficients of these transversal filters are changed in accordance with an output of the coefficient variable circuit 42 responsive to a count value of the horizontal position counter 41.

Although these transversal filter have the same construction as that of the transversal filter used in the first or second embodiment, specific roles are assigned to them. More specifically, in the red video signal voltage compensation circuit 20R, the red transversal filter 30RR compensates distortion of red video signals, the red transversal filter 30GR alleviates interference of green video signals in red video signals, and the blue transversal filter 30BR alleviates interference of blue video signal in the red video signals.

Outputs from the red transversal filter 30RR, green transversal filter 30GR and blue transversal filter 30BR are added by the adder 43, then DA converted by the DA converter 44, and applied to the red signal line of the video signal transmission bus 53" through an amplifier 50R.

Also the green video signal voltage compensation circuit 20G and the blue video signal voltage compensation circuit 20B similarly compensate signal distortion and alleviate interference for green and blue video signals, respectively, and compensated blue and green video signals are delivered to green and blue signal lines of the video signal transmission bus 53 via amplifiers 50GR and 50BR, respectively.

Since a capacitance in the video signal transmission bus may vary with signal voltage, the dependency of the capacitance upon video signal voltages may be taken into account as an additional factor for determining coefficients of the transversal filter in any of the embodiments. For example, coefficients of the transversal filter may be chosen with reference to the average value of video signal voltages.

What is claimed is:

1. A display apparatus comprising:

a plurality of pixel capacitors in a matrix arrangement;

a video signal transmission bus for transmitting a video signal, said video signal transmission bus being disposed in parallel with one side of the display apparatus;

a plurality of sample-hold circuits connected to said video signal transmission bus to sample-hold said video signal in synchronism with a horizontal synchronizing signal;

a plurality of signal lines for delivering sampled video signal from said sample-hold circuits to said pixel capacitors via switching elements; and a video signal voltage compensation circuit located at an input portion of said video signal transmission bus and provided with a filter for receiving said horizontal synchronizing signal and for varying frequency-amplitude characteristics of said video signal to be outputted to said video signal transmission bus in response to elapsed time from a reception of said horizontal synchronizing signal, wherein said sample-hold circuits are a plurality of analog switches which are controlled in sample-holding operation by a signal responsive to said horizontal synchronizing signal and wherein a part of said analog switches disposed along the video signal transmission buses are adapted to close to connect between the video signal transmission buses and the signal lines.

2. The display apparatus according to claim 1, wherein said filter is a transversal filter.

3. The display apparatus according to claim 2, wherein said transversal filter includes:

a plurality of registers connected in series to hold display data;

a plurality of multipliers for multiplying a coefficient applied to be applied to signals before and after each said register; and an adder for adding results of multiplication by said multipliers.

4. The display apparatus according to claim 3, wherein said video signal voltage compensation circuit includes:

a horizontal position counter for counting said horizontal synchronizing signals and for outputting a signal indicating a position on said video signal transmission bus;

a coefficient variable circuit previously holding correction coefficients for different positions on said video signal transmission bus to output appropriate one of said correction coefficients to corresponding one of said multipliers in response to said output of said horizontal position counter; and a digital-to-analog converter for converting a digital output of said adder to analog form and for supplying the analog signal to said video signal transmission bus.

5. The display apparatus according to claim 4, wherein said coefficient variable circuit stores compensation coefficients for different positions of said video signal transmission bus in addresses corresponding to counted values of said horizontal synchronizing signals.

6. The display apparatus according to claim 1, further comprising a terminating resistor connected between said video signal voltage compensation circuit and said video signal transmission bus to prevent reflected signals from traveling back from the terminal end of said video signal transmission bus.

7. A display apparatus comprising:

a plurality of pixel capacitors in a matrix arrangement individually for three primary colors;

first, second, and third video signal transmission buses for transmitting three primary color video signals, said video signal transmission buses being disposed in parallel with one side of the display apparatus;

first to third sample-hold circuit blocks connected to said first to third video signal transmission buses to sample-hold said video signals in synchronism with horizontal synchronizing signals;

a plurality of signal lines for delivering sampled video signals from individual sample-hold circuits in said first to third sample-hold circuit blocks via switching elements; and first and third video signal voltage compensating circuits connected to input portions of said first to third video signal transmission buses and provided with first and third filters for receiving said horizontal synchronizing signals and for respectively varying frequency-amplitude characteristics of said video signal to be outputted to said video signal transmission buses in response to elapsed time from a reception of said horizontal synchronizing signals, wherein said sample-hold circuits are a plurality of analog switches which are controlled in sample-holding operation by a signal responsive to said horizontal synchronizing signal and wherein a part of said analog switches disposed alone the video signal transmission buses are adapted to close to connect between the video signal transmission buses and the signal lines.

8. The display apparatus according to claim 7, wherein each of said first to third filters filters includes:

a plurality of registers connected in series to hold display data;

a plurality of multipliers for multiplying coefficients to be applied to signals before and after each said register; and an adder for adding results of multiplication by said multipliers.

9. The display apparatus according to claim 8, wherein each of said first to third video signal voltage compensation circuits includes:

a horizontal position counter for counting said horizontal synchronizing signals and for outputting a signal indicating a position on said video signal transmission bus;

a coefficient variable circuit previously holding correction coefficients for different positions on said video signal transmission bus to output appropriate one of said correction coefficients to corresponding one of said multipliers in response to said output of said horizontal position counter; and a digital-to-analog converter for converting a digital output of said adder into analog form and for supplying the converted analog signal to said video signal transmission bus.

* * * * *